US008629776B2

(12) United States Patent
Buck et al.

(10) Patent No.: US 8,629,776 B2
(45) Date of Patent: Jan. 14, 2014

(54) SYSTEMS AND METHODS FOR DISRUPTING CRIMINAL ACTIVITY

(75) Inventors: James J. Buck, Longmont, CO (US); Joseph P. Newell, Louisville, CO (US)

(73) Assignee: BI Incorporated, Boulder, CO (US)

( * ) Notice: Subject to any disclaimer, the term of this patent is extended or adjusted under 35 U.S.C. 154(b) by 425 days.

(21) Appl. No.: 12/953,321

(22) Filed: Nov. 23, 2010

(65) Prior Publication Data

US 2011/0133937 A1 Jun. 9, 2011

Related U.S. Application Data

(60) Provisional application No. 61/266,203, filed on Dec. 3, 2009.

(51) Int. Cl.
*G08B 23/00* (2006.01)

(52) U.S. Cl.
USPC ..... 340/573.1

(58) Field of Classification Search
USPC ..... 340/573.1, 686.1, 506, 539.13, 539.23, 340/573.4, 3.1, 13.24; 455/404.2
See application file for complete search history.

(56) References Cited

U.S. PATENT DOCUMENTS

| | | | | |
|---|---|---|---|---|
| 4,475,481 | A | 10/1984 | Carroll | |
| 4,549,264 | A | 10/1985 | Carroll | |
| 4,658,357 | A | 4/1987 | Carroll | |
| 4,724,427 | A | 2/1988 | Carroll | |
| 4,777,477 | A | 10/1988 | Watson | |
| 4,821,823 | A | 4/1989 | Skibinski | |
| 4,843,377 | A | 6/1989 | Fuller | |
| 4,857,893 | A | 8/1989 | Carroll | |
| 4,885,571 | A | 12/1989 | Pauley | |
| 4,916,435 | A | 4/1990 | Fuller | |
| 4,918,432 | A | 4/1990 | Pauley | |
| 4,996,161 | A | 2/1991 | Conners | |
| 4,999,613 | A | 3/1991 | Williamson | |
| 5,043,736 | A | 8/1991 | Darnell | |
| 5,146,207 | A | 9/1992 | Henry | |
| 5,220,919 | A | 6/1993 | Phillips | |
| 5,627,520 | A | 5/1997 | Grubbs | |
| 5,731,757 | A | 3/1998 | Layson, Jr. | |
| 5,828,306 | A * | 10/1998 | Curran | 340/573.4 |

(Continued)

FOREIGN PATENT DOCUMENTS

| | | |
|---|---|---|
| WO | WO/98/08204 | 2/1998 |
| WO | WO/00/77688 | 12/2000 |

(Continued)

OTHER PUBLICATIONS

U.S. Appl. No. 12/041,746, Mar. 4, 2008, Buck, et al.

(Continued)

*Primary Examiner* — Phung Nguyen
(74) *Attorney, Agent, or Firm* — Hamilton DeSanctis & Cha

(57) ABSTRACT

Various embodiments of the present invention provide systems and method for behavior determination. As an example, a system for behavior determination is disclosed that includes: a first monitoring device, a second monitoring device, and a monitoring system. The monitoring system is operable to: receive information from the first monitoring device; receive information from the second monitoring device; identify at least a first zone around the first monitoring device; identify at least a second zone around the second monitoring device; and characterize an intersection of the first zone and the second zone.

21 Claims, 7 Drawing Sheets

(56) References Cited

U.S. PATENT DOCUMENTS

| | | | | |
|---|---|---|---|---|
| 5,867,103 | A | 2/1999 | Taylor, Jr. | |
| 5,889,474 | A | 3/1999 | Ladue | |
| 5,923,300 | A | 7/1999 | Meija | |
| 5,936,529 | A | 8/1999 | Reisman et al. | |
| 5,959,533 | A | 9/1999 | Layson, Jr. | |
| 5,982,281 | A | 11/1999 | Layson, Jr. | |
| 6,014,080 | A | 1/2000 | Layson, Jr. | |
| 6,072,396 | A | 6/2000 | Gaukel | |
| 6,130,620 | A | 10/2000 | Pinnow et al. | |
| 6,160,481 | A | 12/2000 | Taylor | |
| 6,218,945 | B1 | 4/2001 | Taylor | |
| 6,512,456 | B1 | 1/2003 | Taylor | |
| 6,606,304 | B1 | 8/2003 | Grinter | |
| 6,674,368 | B2 | 1/2004 | Hawkins et al. | |
| 6,700,547 | B2 | 3/2004 | Mieja et al. | |
| 6,703,936 | B2 | 3/2004 | Hill et al. | |
| 6,774,797 | B2 | 8/2004 | Freathy | |
| 6,774,799 | B2 | 8/2004 | Defant | |
| RE38,838 | E | 10/2005 | Taylor | |
| 6,992,582 | B2 | 1/2006 | Hill et al. | |
| 7,038,590 | B2 | 5/2006 | Hoffman et al. | |
| 7,102,510 | B2 | 9/2006 | Boling et al. | |
| 7,119,695 | B2 | 10/2006 | Defant et al. | |
| 7,123,141 | B2 * | 10/2006 | Contestabile | 340/539.13 |
| 7,205,890 | B2 | 4/2007 | Defant et al. | |
| RE39,909 | E | 11/2007 | Taylor | |
| 7,330,122 | B2 | 2/2008 | Derrick | |
| 7,386,152 | B2 | 6/2008 | Rowe et al. | |
| 7,518,500 | B2 | 4/2009 | Aninye | |
| 7,545,318 | B2 | 6/2009 | Derrick | |
| 7,619,513 | B2 | 11/2009 | Hill et al. | |
| 7,701,171 | B2 | 4/2010 | Defant | |
| 7,737,841 | B2 * | 6/2010 | Derrick et al. | 340/539.13 |
| 7,804,412 | B2 | 9/2010 | Derrick | |
| 7,930,927 | B2 | 4/2011 | Cooper et al. | |
| 7,936,262 | B2 | 5/2011 | Derrick | |
| 7,961,092 | B2 * | 6/2011 | Freathy et al. | 340/539.13 |
| RE42,671 | E | 9/2011 | Taylor | |
| 2002/0140559 | A1 | 10/2002 | Zhou et al. | |
| 2003/0109988 | A1 | 6/2003 | Geissler et al. | |
| 2003/0210149 | A1 | 11/2003 | Reisman et al. | |
| 2004/0174264 | A1 * | 9/2004 | Reisman et al. | 340/573.4 |
| 2004/0236199 | A1 | 11/2004 | Hawthorne et al. | |
| 2005/0250440 | A1 | 11/2005 | Zhou et al. | |
| 2006/0202836 | A1 | 9/2006 | Hawthorne et al. | |
| 2006/0202837 | A1 | 9/2006 | Hawthorne et al. | |
| 2008/0012760 | A1 | 1/2008 | Derrick | |
| 2008/0108370 | A1 | 5/2008 | Aninye | |
| 2008/0316022 | A1 | 12/2008 | Buck et al. | |
| 2010/0123589 | A1 | 5/2010 | Buck et al. | |
| 2010/0240969 | A1 | 9/2010 | Rompa et al. | |
| 2011/0133928 | A1 | 6/2011 | Buck et al. | |
| 2011/0154887 | A1 | 6/2011 | Cooper et al. | |

FOREIGN PATENT DOCUMENTS

| | | |
|---|---|---|
| WO | WO/2005/019977 | 3/2005 |
| WO | WO/2005/038590 | 4/2005 |
| WO | WO/2006/108077 | 10/2006 |
| WO | WO/2006/121930 | 11/2006 |
| WO | WO/2006/122004 | 11/2006 |
| WO | WO2007/027943 | 3/2007 |
| WO | WO/2007/037794 | 4/2007 |
| WO | WO/2008/008666 | 1/2008 |
| WO | WO/2008/008667 | 1/2008 |
| WO | WO/2008/008669 | 1/2008 |
| WO | WO/2008/008670 | 1/2008 |
| WO | WO/2008/027948 | 3/2008 |
| WO | WO/2008/027985 | 3/2008 |

OTHER PUBLICATIONS

U.S. Appl. No. 12/714,581, Mar. 1, 2010, Buck et al.

Marques, et al., "Evaluating Transdermal Alcohol Measuring Devices" Pacific Institute for Research and Evaluation, NHTSA, Nov. 2007 pp. 1-96.

Pollard, et al. "Review of Technology to Prevent Alcohol-Impaired Crashes" U>S> Department of Transportation NHTSA, DOT HS 810 833, Sep. 2007, pp. 1-108.

Pollard, et al "Vehicle Technologies to Prevent Crashes Involving Alcohol-Impaired Drivers" The Volpe Center, Aug. 11, 2006, pp. 1-28.

Ratcliffe, "www.stltoday.com," Dec. 26, 2007, pp. 1-2. Retrieved from internet http://www.stltoday.com/stltoday/emaf.nsf/Popup retrieved on Jan. 18, 2008.

Roberston, et al. "Continuous Transdermal Alcohol Monitoring : A primer for Criminal Justice Professionals" Traffic Injury Research Foundation, Oct. 2006, pp. 1-34.

Shellem, "SCRAM Can Alert Probation Officers if Someone's Been Drinking", The Patriot-News, Nov. 25, 2007, pp. 1-3.

* cited by examiner

SYSTEMS AND METHODS FOR DISRUPTING CRIMINAL ACTIVITY

CROSS REFERENCE TO RELATED APPLICATION

The present application claims priority to (i.e., is a non-provisional of) U.S. Pat. App. No. 61/266,203 entitled "Systems and Methods for Disrupting Criminal Activity", and filed Dec. 3, 2009 by Buck. The entirety of the aforementioned application is incorporated herein by reference for all purposes.

BACKGROUND OF THE INVENTION

The present invention is related to monitoring movement, and in particular to systems and methods for monitoring contact between identified criminal elements.

Various approaches have been used to monitor the location and activity of individuals that for one reason or another require additional supervision. As an example, a tracking device may be attached to an individual and used to report the location of the individual at any given time. This information has traditionally been used by, for example, a parole officer assigned to monitor the individual to assure that the individual is staying within the parameters of their parole. Such a monitoring agency system gathers location information associated with a number of individuals being monitored and stores it to a database. This database may then be accessed by an authorized entity to monitor the activity of a given individual. Merely providing location information to a monitoring agent may not allow for effective interruption of criminal activity.

Hence, for at least the aforementioned reasons, there exists a need in the art for advanced systems and methods for monitoring entities.

BRIEF SUMMARY OF THE INVENTION

The present invention is related to monitoring movement, and in particular to systems and methods for monitoring contact between identified criminal elements.

Various embodiments of the present invention provide behavior determination systems. Such systems include a first monitoring device, a second monitoring device, and a monitoring system. The monitoring system is operable to: receive information from the first monitoring device; receive information from the second monitoring device; identify at least a first zone around the first monitoring device; identify at least a second zone around the second monitoring device; and characterize an intersection of the first zone and the second zone.

In some instances of the aforementioned embodiments, the monitoring system includes a processor and a computer readable medium. The computer readable medium has instructions executable by the processor to: receive the information from the first monitoring device; receive the information from the second monitoring device; identify at least the first zone around the first monitoring device; identify at least the second zone around the second monitoring device; and characterize the intersection of the first zone and the second zone.

In various instances of the aforementioned embodiments, characterizing the intersection of the first zone and the second zone includes: determining that a first individual associated with the first monitoring device is friendly with a second individual associated with the second monitoring device; and characterizing the intersection as a friendly interaction. In some cases, the monitoring system is further operable to provide an alert indicating the friendly interaction. In various cases, the friendly interaction corresponds to a common gang affiliation of the first individual and the second individual.

In particular instances of the aforementioned embodiments, the monitoring system is further operable to define a common zone around both the first monitoring device and the second monitoring device. In such instances, the interaction is a first interaction, and the monitoring system is further operable to: receive information from a third monitoring device; identify at least a third zone around the third monitoring device; and characterize a second intersection of the third zone and the common zone. In some cases, characterizing the second intersection includes: determining that a first individual associated with the first monitoring device is unfriendly with a third individual associated with the third monitoring device; and characterizing the intersection as an unfriendly interaction.

In one or more instances of the aforementioned embodiments, characterizing the intersection of the first zone and the second zone includes: determining that a first individual associated with the first monitoring device is unfriendly with a second individual associated with the second monitoring device; and characterizing the intersection as an unfriendly interaction. In some cases, the monitoring system is further operable to providing an alert indicating the unfriendly interaction. In some such cases, the friendly interaction corresponds to an adverse gang affiliation of the first individual and the second individual.

Other embodiments of the present invention provide methods for behavior determination. Such methods include: monitoring a first location of a first monitoring device; monitoring a second location of a second monitoring device; receiving the first location from the first monitoring device; receiving the second location from the second monitoring device; identifying at least a first zone around the first monitoring device; identifying at least a second zone around the second monitoring device; and characterizing an intersection of the first zone and the second zone.

In some cases, characterizing the intersection of the first zone and the second zone includes: determining that a first individual associated with the first monitoring device is friendly with a second individual associated with the second monitoring device; and characterizing the intersection as a friendly interaction. In particular cases, the methods further include providing an alert indicating the friendly interaction. In other cases, the methods further include defining a common zone around both the first monitoring device and the second monitoring device. In some such cases, the interaction is a first interaction, and the methods further include: receiving information from a third monitoring device; identifying at least a third zone around the third monitoring device; and characterizing a second intersection of the third zone and the common zone. In one or more cases, characterizing the second intersection includes: determining that a first individual associated with the first monitoring device is unfriendly with a third individual associated with the third monitoring device; and characterizing the intersection as an unfriendly interaction. Characterizing the intersection of the first zone and the second zone may include: determining that a first individual associated with the first monitoring device is unfriendly with a second individual associated with the second monitoring device; and characterizing the intersection as an unfriendly interaction.

Yet other embodiments of the present invention provide computer readable media having instructions executable by a processor to: receive information from the first monitoring device; receive information from the second monitoring device; identify at least a first zone around the first monitoring device; identify at least a second zone around the second monitoring device; and characterize an intersection of the first zone and the second zone.

This summary provides only a general outline of some embodiments according to the present invention. Many other objects, features, advantages and other embodiments of the present invention will become more fully apparent from the following detailed description, the appended claims and the accompanying drawings and figures.

BRIEF DESCRIPTION OF THE DRAWINGS

A further understanding of the various embodiments of the present invention may be realized by reference to the figures which are described in remaining portions of the specification. In the figures, similar reference numerals are used throughout several drawings to refer to similar components. In some instances, a sub-label consisting of a lower case letter is associated with a reference numeral to denote one of multiple similar components. When reference is made to a reference numeral without specification to an existing sub-label, it is intended to refer to all such multiple similar components.

DETAILED DESCRIPTION OF THE INVENTION

The present invention is related to monitoring movement, and in particular to systems and methods for monitoring contact between identified criminal elements.

Various approaches and systems have been developed for monitoring the location of individuals. As an example, U.S. patent application Ser. No. 12/041,746 entitled "Beacon Based Tracking Device and Methods for Using Such" and filed Mar. 4, 2008 by Buck et al. discloses a monitoring system. As another example, U.S. patent application Ser. No. 12/608,109 entitled "Systems and Methods for Adaptive Monitoring of Physical Movement" and filed Oct. 29, 2009 by Buck discloses another monitoring system. Each of the aforementioned patent applications is assigned to an entity common hereto and share a common inventor. In addition, each of the aforementioned patent applications is incorporated herein by reference for all purposes. Among other things, such monitoring systems monitor the location of a number of individuals and report that location to a central database. In some cases, the monitoring of the individuals is forced by a judicial system due to a conviction of the individual for prior criminal activity. In other cases, the monitoring is consensual.

Those who have a history of criminal behavior often become involved in additional criminal behavior after being released from incarceration even though they are being monitored. One of the factors in their return to criminal behavior is involvement with a gang. Various embodiments of the present invention leverage the location information about individuals with prior criminal records to intervene and/or disrupt gang related activities by learning gang relationships and patterns of activities through use of information related to monitored individuals.

Various embodiments of the present invention provide systems and methods for monitoring individuals to identify a probability of impending or ongoing criminal activity, and/or locations with a high probability of criminal behavior. In some cases, the monitored entities are humans. In such cases, the systems and methods may further include a warning of a potential impending or ongoing criminal activity, and/or locations with a high probability of criminal behavior.

Figure 1:
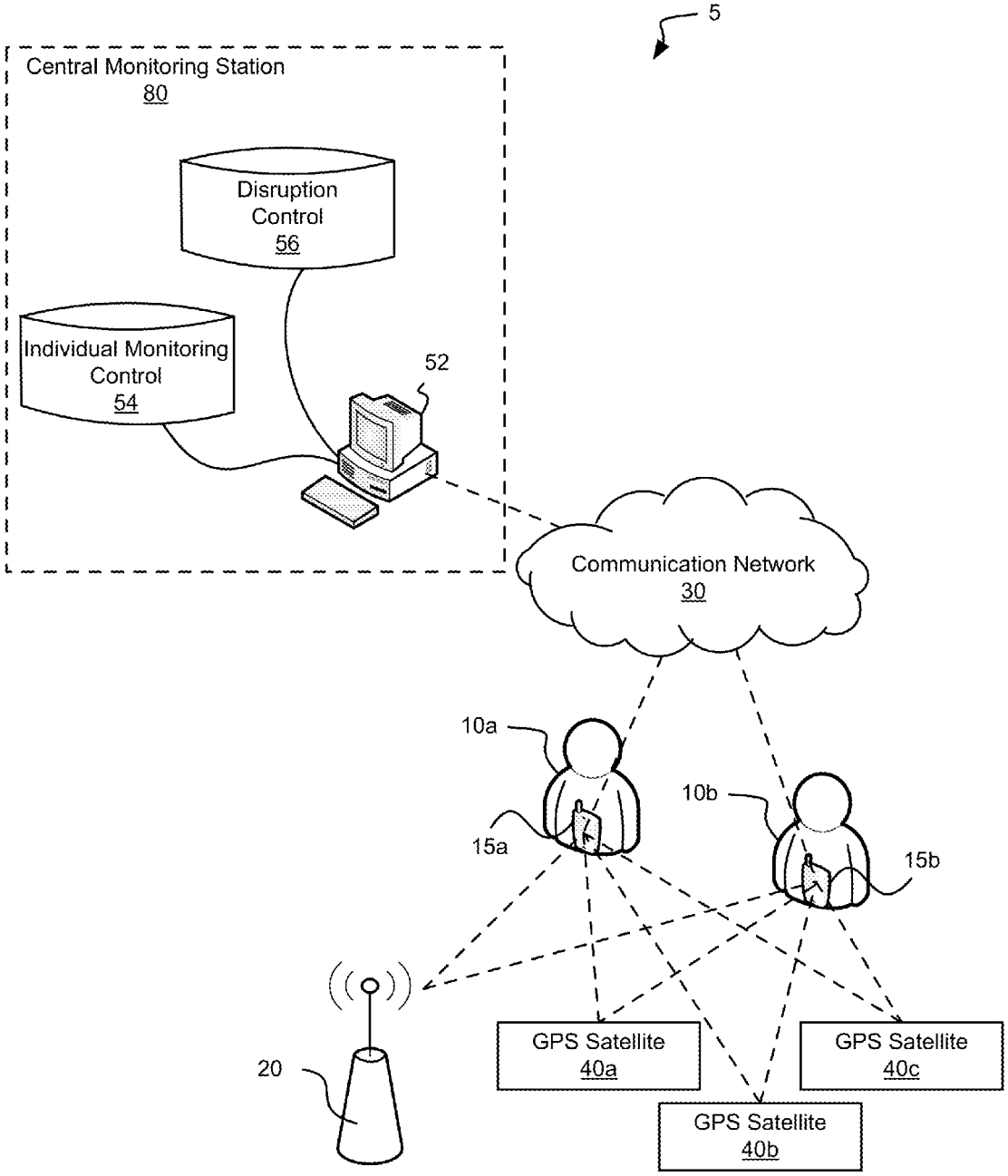
FIG. 1 depicts a monitoring system including a monitoring agency system with disruption control in accordance with one or more embodiments of the present invention.

Turning to FIG. 1, a monitoring system 5 is shown that includes a central monitoring station 80 employing disruption control 56 in accordance with one or more embodiments of the present invention. Monitoring system 5 includes a number of location monitoring devices 15 that are each attached to respective individuals 10. In some cases, at least a subset of individuals 10 have been identified as being associated with criminal behavior. Monitoring devices 15 are capable of receiving GPS location information from GPS satellites 40 and/or terrestrial based location reference systems 20. This location information may be time stamped and transmitted on a periodic or real time basis to a central monitoring station 80 via a communication network 30.

Central monitoring station 80 includes an individual monitoring control 54 that is responsible for monitoring the location of a number of individuals 10 that are transmitting location information to a server 52 via communication network 30. In addition, central monitoring station 80 is operable to determine interactions between various of individuals 10, and to use the determined interactions to identify groups of potential co-conspirators, locations frequented by the groups, and/or impending or ongoing criminal behavior. Server 52 may be any device or system known in the art that is capable of receiving information via communication network 30 and for performing operations as directed by individual monitoring control 54 and/or disruption control 56. In some embodiments of the present invention, server 52 is a microprocessor based device. In such embodiments, disruption control 56 may be a computer readable medium including instructions executable by a microprocessor to implement the operations related to disruption control 56. Similarly, individual monitoring control 54 may be a computer readable medium including instructions executable by a microprocessor to implement the operations related to individual monitoring control 54.

In some embodiments of the present invention the location is time stamped, and the time stamp information is provided to central monitoring station 80. Disruption control 56 of central monitoring station 80 uses the location information from monitoring devices 15 along with particular geographic information to determine probabilities of criminal behavior involving individuals 10*a*, 10*b*. Based upon the disclosure provided herein, one of ordinary skill in the art will recognize other information that may be utilized to determine probabilities of criminal behavior involving individuals 10*a*, 10*b*.

Communication network 30 may be, for example, a cellular telephone network or other communication networks.

Based upon the disclosure provided herein, one of ordinary skill in the art will recognize a variety of communications networks and combinations of communications networks that may be used in relation to different embodiments of the present invention to transfer information between monitoring devices 15 and central monitoring station 80.

In operation, central monitoring station 80 receives location information from monitoring devices 15 each associated with respective individuals 10. Individual monitoring control 54 maintains the received information and compares the information against rules intended to limit movement of the respective individuals 10. The rules may be programmed or otherwise updated using any approach known in the art. The rules may be specific to a given individual 10 indicating locations that the given individual is not allowed to be. For example, in the case where a restraining order is entered disallowing contact by individual 10*a* to individual 10*b*, the a perimeter around the residence and/or work place of individual 10*b* may be indicated as areas where individual 10*a* is not allowed to enter. Where individual 10*a* violates one of these regions, individual monitoring control 54 causes central monitoring station 80 to issue a violation update to monitoring recipient (not shown) charged with monitoring individual 10*a*.

Disruption control 56 utilizes location information from monitoring devices 15 to determine a potential or probability of criminal activity involving two individuals 10. For example, where individual 10*a* is a known gang member that is frequently co-located with individual 10*b*, it may be determined that individual 10*b* belongs to the same gang as individual 10*a*. Further, surveillance of the location where individual 10*a* and individual 10*b* interact may identify other unmonitored individuals which may be involved in the same gang. Where a location is identified where individual 10*a* and individual 10*b* interact, disruption control 56 may cause central monitoring station 80 to issue a warning to law enforcement identifying the location. The warning may be issued in any number of ways including, but not limited to, via email, text message, voice call, and/or physical mail. As another example, where a large number of individuals known to be affiliated with the same gang meet at a common location that was not previously frequented, disruption control 56 may cause central monitoring station 80 to issue a warning to law enforcement identifying the location as a location of a possible impending or ongoing criminal behavior. As yet another example, where a large number of individuals known to be affiliated with two different gangs are moving toward a common location, disruption control 56 may cause central monitoring station 80 to issue a warning to law enforcement identifying the location as a location of a possible impending or ongoing criminal behavior. Based upon the disclosure provided herein, one of ordinary skill in the art will recognize a variety of other detectable interactions that may form the basis of warnings or alerts sent to a law enforcement agency. In some cases, in addition to the warning may cause central monitoring station 80 issue instructions for how to proceed to reduce the determined potential for contact. The aforementioned warnings may be communicated to the respective individuals 10 from central monitoring station 80 via communication network 30. The message(s) may be received via monitoring device(s) 15 or via other communication devices associated with the respective monitored individuals 10 such as, for example, cell phones.

The probability of criminal interaction may be based on various factors that can be discerned from the location of individuals and/or the rate of movement of one of more of individuals 10. For example, a probability of criminal interaction may be determined to be low where one or more of individuals 10 are traveling at a high rate of speed suggesting more of an incidental passing rather than an intent to contact. As another example, a probability of criminal interaction may be determined to be greater when a direction of travel of an individual 10 is toward a restricted or otherwise identified area. As yet another example, a probability of contact may be heightened when individuals that are expected to avoid contact are located in an area known to be frequented by one of the individuals 10 as compared with a similarly proximity in an area that is not known to be frequented by one of the individuals 10. Based upon the disclosure provided herein, one of ordinary skill in the art will recognize a variety of information that may be used in determining probability of criminal interaction.

Figure 2:
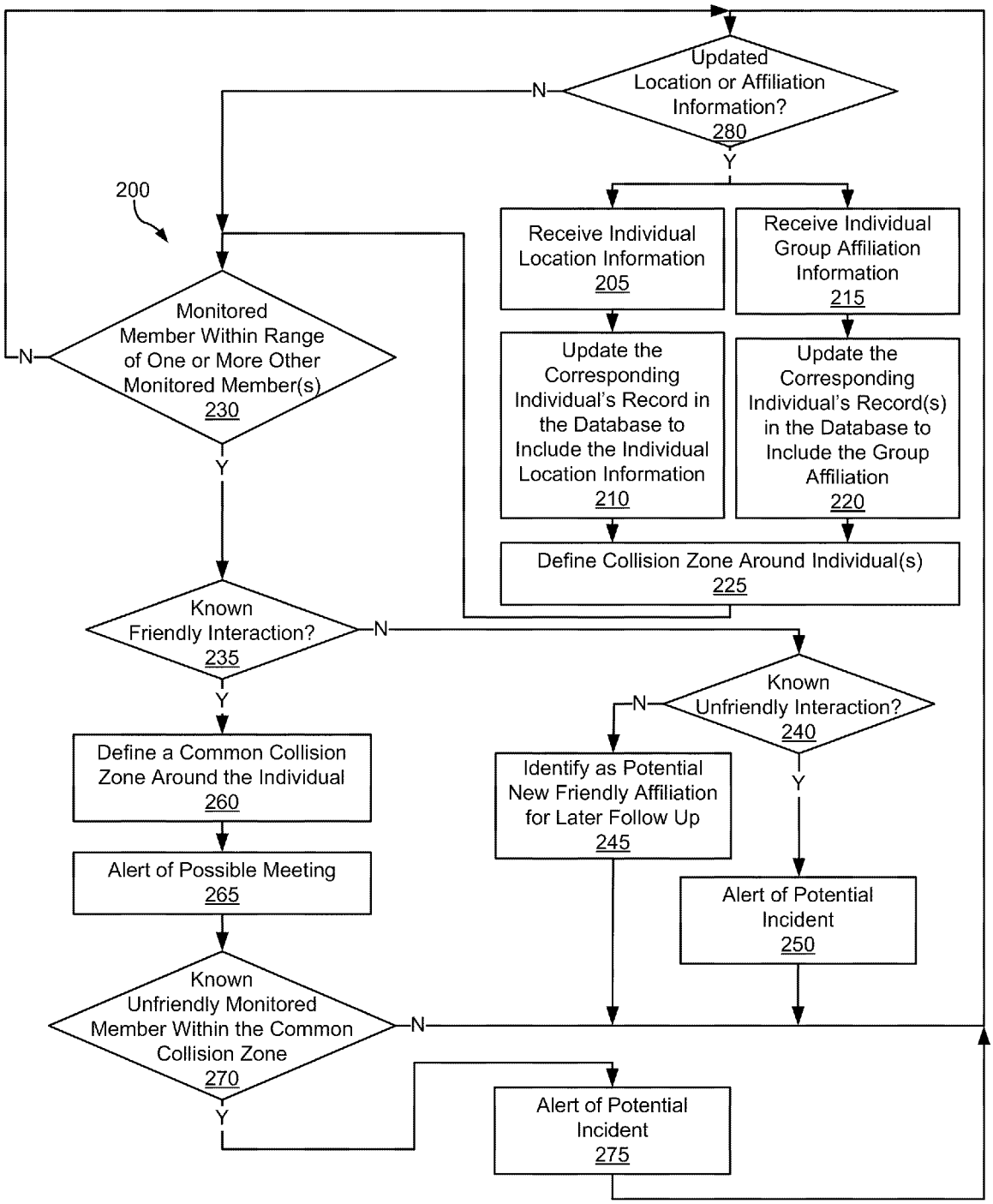
FIG. 2 is a flow diagram showing a method in accordance with some embodiments of the present invention for disrupting, predicting and/or monitoring criminal behavior.

Turning to FIG. 2, a flow diagram 200 shows a method in accordance with some embodiments of the present invention for disrupting, predicting and/or monitoring criminal behavior. Following flow diagram 200, it is determined whether updated information is available (block 280). The updated information may include, but is not limited to, the location of one or more individuals being monitored, or group affiliations. The updated location information may be continuously received from individual monitoring control 54. Group affiliations may be updated by a law enforcement officer or other individual that has information about a given affiliation. In some cases, an affiliation determination may be triggered where an alert is generated indicating an interaction between previously unaffiliated individuals (see e.g., block 245).

Where updated information is available (block 280), any received location information is received (block 205), and the received location information is used to update the record of a monitored individual (block 210). In addition, any Individual group affiliation information is received (block 215), and the records of one or more individual's indicated by the group affiliation are updated to indicate the affiliation (block 220). For example, an individual Y may be identified as part of or friendly with group Z. In this case, the record associated with individual Y is updated to indicate the affiliation with other monitored individuals within group Z. Alternatively, the individual Y may be identified as unfriendly with a group W. In this case, the record associated with individual Y is updated to indicate the unfriendly affiliation with other monitored individuals within group Z. As yet another example, a group A may be identified as unfriendly with a group B. In such a case, all members of group A may be identified as unfriendly with all members of group B. As yet another example, a group C may be identified as friendly with a group D. In such a case, all members of group C may be identified as friendly with all members of group D. Based upon the disclosure provided herein, one or ordinary skill in the art will recognize other affiliations that may be used in relation to different embodiments of the present invention.

Using the updated information the collision zones around the individuals are defined (block 225). These collisions zones may be programmed to be any defined size. In some cases, the collision zones are the same size around each individual. In contrast, in other cases, the collision zones may be a different size for one individual than for another.

Where either the aforementioned update has been completed (blocks 205, 210, 215, 220, 225) or an update was not called for (block 280), it is determined whether a monitored individual is within a defined proximity of another monitored individual (block 230). This may include determining whether a collision zone associated with one monitored individual overlaps that of another monitored individual. Where it is determined that one monitored individual is within proximity of another monitored individual (block 230), it is determined whether the monitored individuals identified as being within proximity of each other are known to be friendly with each other (block 235). This determination is made based upon the affiliation information updated in blocks 215, 220.

Where it is not known whether the individuals are friendly (block 235), it is determined whether the monitored individuals are known to be unfriendly with each other (block 240). Again, this determination is made based upon the affiliation information updated in blocks 215, 220. Where it is not known whether the monitored individuals are unfriendly with each other (block 240), the monitored individuals are identified for further research to discover the relationship between the individuals (block 245). This may include alerting law enforcement of the interaction. Where it is determined that the individuals are friendly (e.g., part of the same gang), this affiliation may be updated.

Alternatively, where it is determined that the monitored individuals are unfriendly with each other (block 240), law enforcement may be alerted of a potential incident at the location where the co-location of the monitored individuals was detected (block 250). Such an alert may be provided via, for example, an email, a text message, a voice mail, or the like.

Alternatively, where it is known that the monitored individuals are friendly (block 235), a common collision zone is defined around the monitored individuals (block 260). As an example, the common collision zone may encompass the collision zones around each of the monitored individuals, and in some cases an area beyond the individual collision zones. In addition, an alert of a possible meeting is provided to law enforcement (block 265). Again, such an alert may be provided via, for example, an email, a text message, a voice mail, or the like.

It is determined whether an unfriendly, monitored individual has come within range of the common collision zone (block 270). This may be determined by determining whether there is an overlap between the aforementioned common collision zone and an individual collision zone around the unfriendly, monitored individual. Where it is determined that there is an overlap with the common collision zone (block 270), an alert of a possible incident is provided to law enforcement (block 275). Again, such an alert may be provided via, for example, an email, a text message, a voice mail, or the like.

Figure 3:
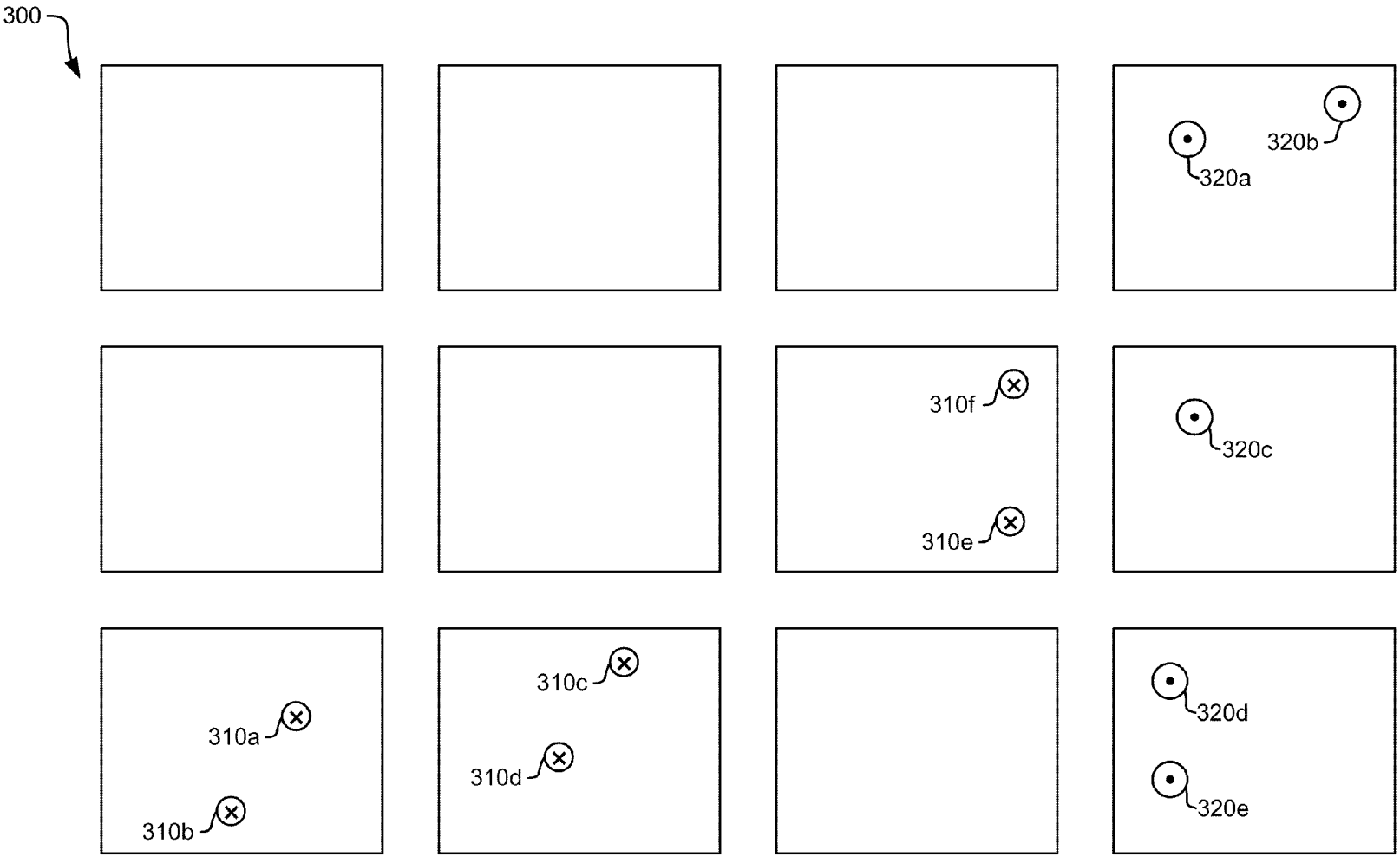
FIG. 3 shows a map of several blocks of a city on which the location of a number of known gang members are indicated in accordance with various embodiments of the present invention.
Figure 4:
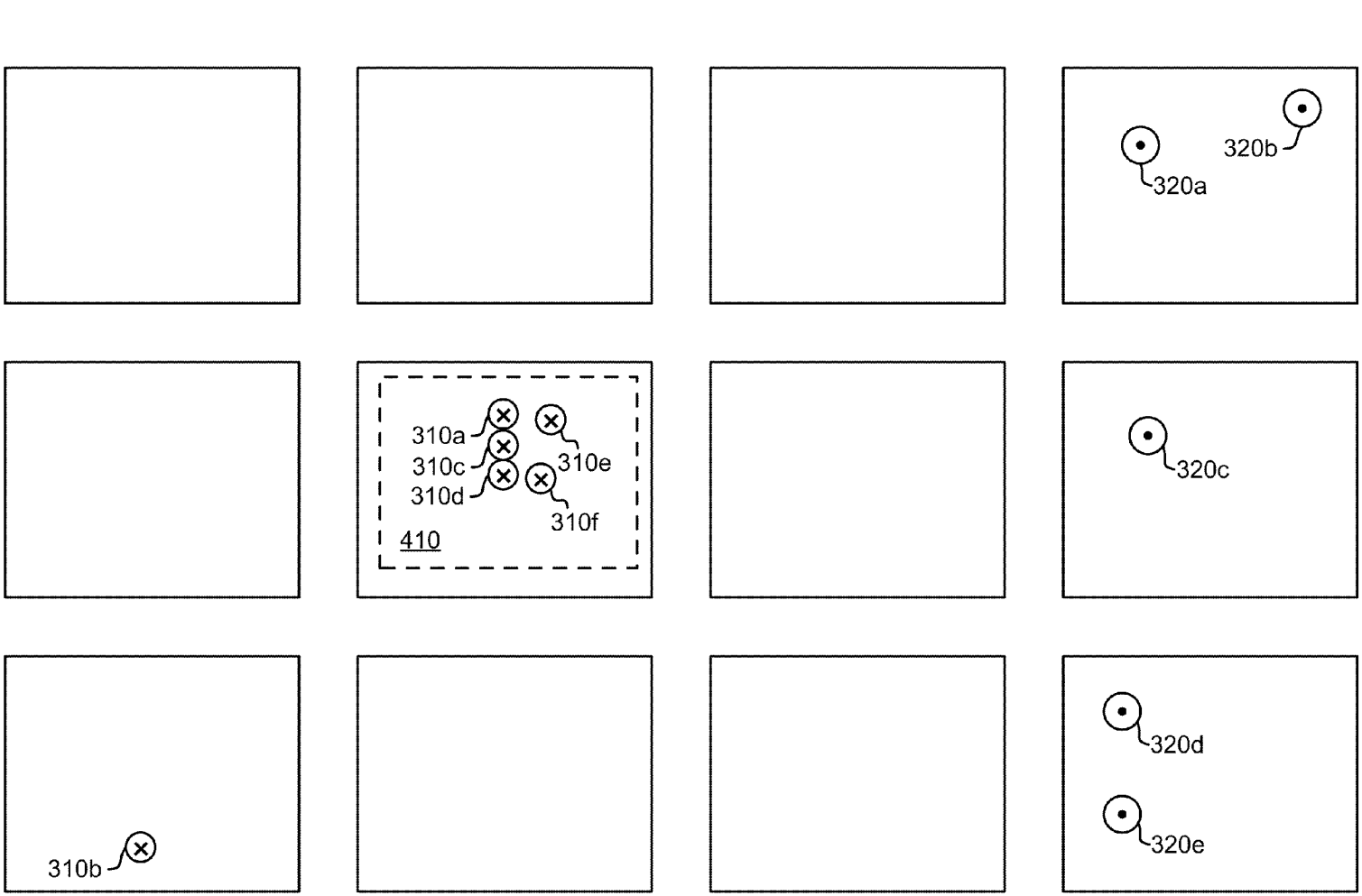
FIG. 4 is the map of FIG. 3 except that a number of the known gang members have been tracked to a common location in accordance with one or more embodiments of the present invention.
Figure 5:
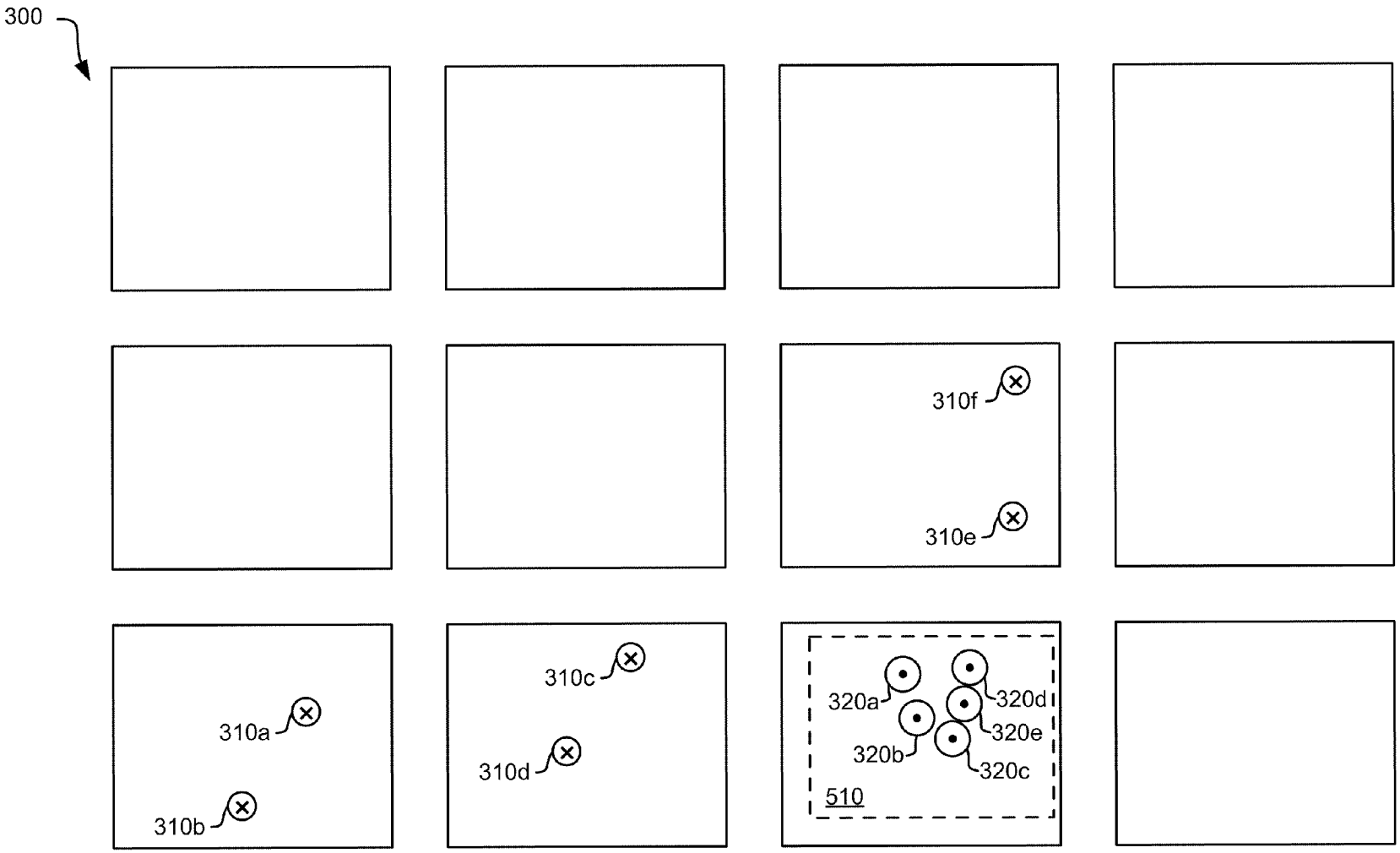
FIG. 5 is the map of FIG. 3 except that a different number of the known gang members that have been tracked to a common location in accordance with particular embodiments of the present invention.

FIGS. 3 through 5 graphically depict a process for determining a potential of criminal behavior. Referring to FIG. 3, a map 300 of several blocks of a city on which the location of a number of known gang members are indicated in accordance with various embodiments of the present invention. The location of known gang members 310*a*, 310*b*, 310*c*, 310*d*, 310*e*, 310*f*, 320*a*, 320*b*, 320*c*, 320*d*, 320*e* are each plotted relative to map 300. Each of the gang members has a tracking bracelet attached to them that reports their movement on either a real time basis or at least is periodically updated. In some cases, the individuals being monitored have known gang affiliations. On map 300, two distinct gang affiliations are indicated by a circle with an X in it or a circle with a dot in it. Thus, the "X" gang includes known members 310*a*, 310*b*, 310*c*, 310*d*, 310*e*, 310*f*, and the "dot" gang includes members 320*a*, 320*b*, 320*c*, 320*d*, 320*e*. As each of these members move, their location on map 300 is updated. The location of each of the gang members is maintained and updated by individual monitoring control 54 of central monitoring station 80. This location information is made available to disruption control 56 that analyzes the information to determine if an opportunity to disrupt criminal behavior is available.

Turning to FIG. 4, map 300 is shown at some point in the future from that discussed in relation to FIG. 3 above with the location of gang members 310*a*, 310*c*, 310*d*, 310*e*, 310*f* moving to a common location 410. Common location 410 is defined as having two or more known members within a defined proximity of each other. For example, it may be defined as having two or more known members without one hundred meters of each other. The co-location of gang members 310*a*, 310*c*, 310*d*, 310*e*, 310*f* at common location 410 may be used by disruption control 56 to classify common location 410 as a gang member meeting location or a potential location of either ongoing or future criminal activity. In this case where gang members 310*a*, 310*c*, 310*d*, 310*e*, 310*f* are all affiliated with the same gang, it may be determined that common location 410 is meeting location for the X gang. Such meeting locations can be used in various criminal endeavors including, but not limited to, drug preparation and distribution, money laundering, conspiracies or the like. By identifying common location 410, additional surveillance resources may be intelligently disbursed to the location allowing for identification of other members of the X gang that are not being monitored and/or for determining any illegal activities, if any, that are being carried out at the location.

Where it becomes known that such surveillance is being directed to meeting locations where monitored individuals (e.g., gang members 310*a*, 310*c*, 310*d*, 310*e*, 310*f*) are co-locating, there will be pressure within the gang to exclude monitored individuals from gang activities. Such a result is desirable as it may operate to break the influence that a gang may have over a particular member allowing them a greater likelihood of being able to turn away from criminal activity.

Turning to FIG. 5, map 300 is shown at some point in the future from that discussed in relation to FIG. 3 above with the location of gang members 320*a*, 320*b*, 320*c*, 320*d*, 320*e* moving to a common location 510, and gang members 320*a*, 320*b*, 320*c*, 320*d*, 320*e* are toward gang members 310*c*, 310*d* of a different gang affiliation. Again, common location 510 is defined as having two or more members within a defined proximity of each other. In this case, where common location 510 includes a number of the dot gang moving toward one or more members of the X gang, it may be assumed that there is a high potential for an incident to occur. In such a case, an alert of the potential incident may be raised to law enforcement that may be able to intervene before anything occurs.

Again, where it becomes known that such surveillance is being directed to meeting locations where monitored individuals (e.g., members 320*a*, 320*b*, 320*c*, 320*d*, 320*e*) are co-locating, there will be pressure within the gang to exclude monitored individuals from gang activities. Such a result is desirable as it may operate to break the influence that a gang may have over a particular member allowing them a greater likelihood of being able to turn away from criminal activity.

Figure 6A:
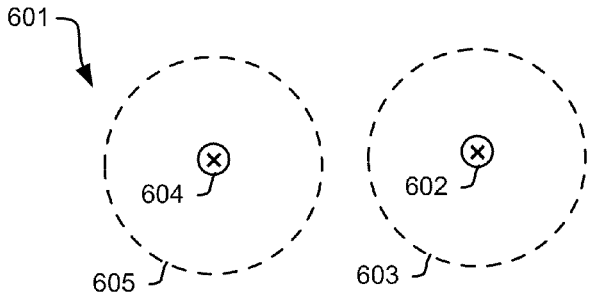
FIGS. 6*a*-6*e* depict a number of co-location scenarios in accordance with one or more embodiments of the present invention.
Figure 6B:
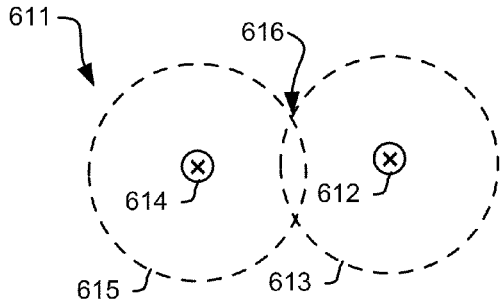

FIGS. 6*a*-6*e* depict a number of co-location scenarios in accordance with one or more embodiments of the present invention. Turning to FIG. 6*a*, a scenario 601 depicts a gang member 602 has a collision zone 603 around him and a member 604 has a collision zone around him/her. Collision zones 603, 605 define a radius around the member that when violated the member will be considered co-located with another member. In the case of scenario 601, collision zones 603, 605 do not intersect. Thus, members 602, 604 are not considered co-located. Of note, sizing collision zones 603, 605 controls the defined proximity that is used to identify common location. In contrast, FIG. 6*b* depicts a scenario 611 with a gang member 412 that has a collision zone 413 around him/her and a member 614 that has a collision zone 615 around him/her. In scenario 611, an intersection 616 between collision zone 613 and collision zone 615 occurs. Because of intersection 616, gang member 612 and gang member 614 are considered co-located or part of a common location. In some cases, the size of collision zones 603, 605 can be modified through programming to adjust the operation of disruption control 56.

Figure 6C:
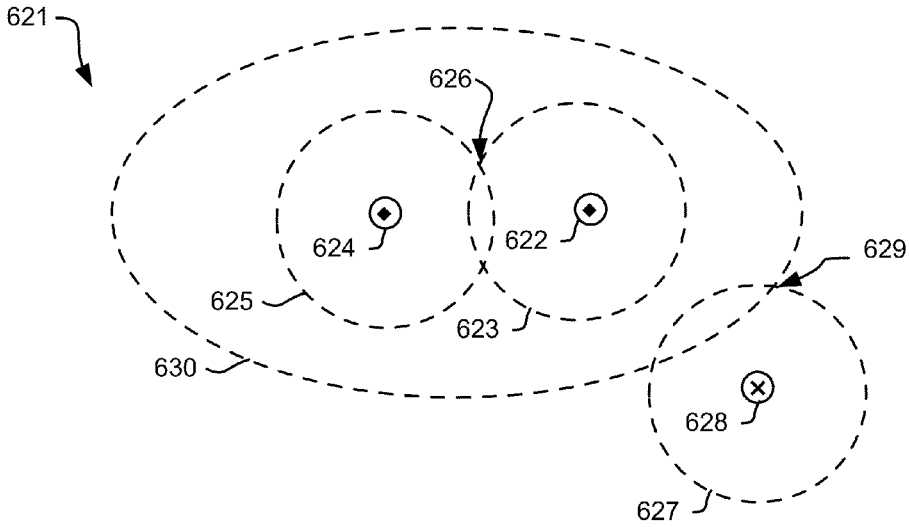
Figure 6D:
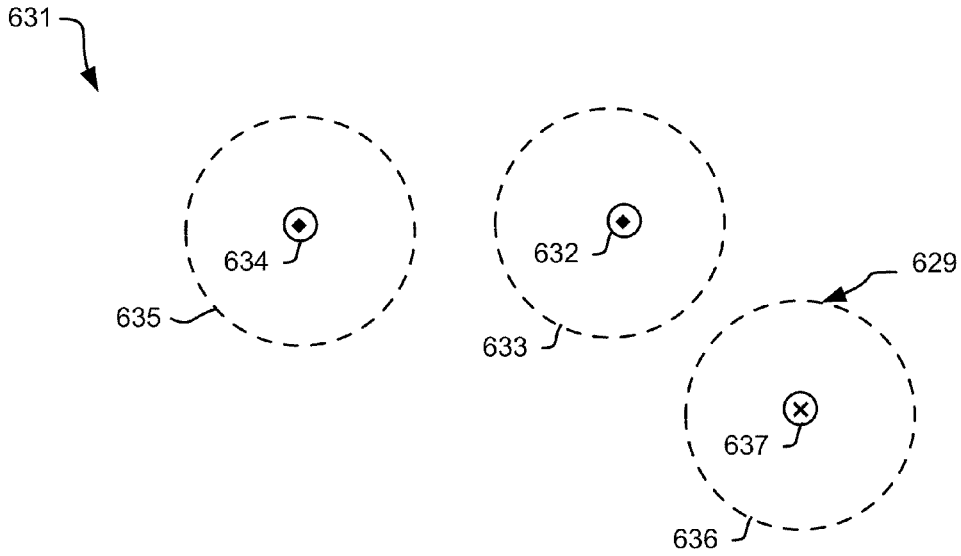

Referring to FIG. 6*c*, a scenario 621 depicts two affiliated gang members 622, 624 within range of an unaffiliated gang member 628. As shown, gang member 622 has a collision zone 623 around him/her and gang member 624 has a collision zone 625 around him/her. Collision zones 623, 625 intersect at an intersection 626. Because of the intersection of the collision zones, gang members 622, 624 are considered co-located or at a common location. Further a common collision zone 630 is defined around the co-located gang members 623, 625. Common collision zone 630 is defined an extended distance around collision zones 623, 625 due to the heightened possibility of criminal activity when two or more affiliated members are co-located. Of note, common collision zone 630 intersects with a collision zone 627 around gang member 628 at an intersection 629. Because of this intersection, members 622, 624, 628 are considered co-located or at a common location. Because gang member 628 is not affiliated with gang members 622, 624, an alert is sent out about a possible incident. In contrast, FIG. 6*d* shows a scenario 631 with a gang member 633 surrounded by a collision zone 632, a gang member 635 surrounded by a collision zone 634, and a gang member 637 surrounded by a collision zone 636. As there is no intersection between any of collision zones 635, 633, 636, none of gang members 634, 632, 637 are considered co-located.

Figure 6E:
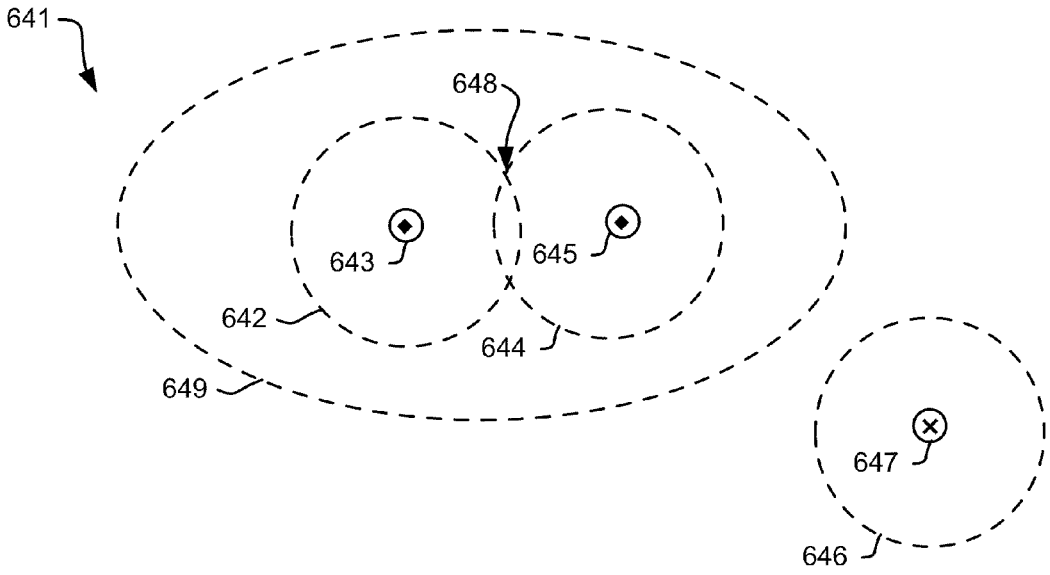

Turning to FIG. 6*e*, a scenario 641 is depicted with a gang member 643 having a collision zone 642 around him/her, a gang member 645 having a collision zone 644 around him/her, and a gang member 647 having a collision zone 646 around him/her. In this scenario, collision zone 642 intersects collision zone 642 at an intersection 648. Because of this intersection, gang members 643, 645 are considered co-located, and a common collision zone 649 is defined around collision zones 642, 644. However, unlike scenario 621, common collision zone 649 does not intersect collision zone 646, and thus a possible incident alert is not sent out. In contrast, because collision zones 642, 644 intersect, a gang meeting location alert may be sent out.

It should be noted that the scenarios described in relation to FIGS. 6*a*-6*e* are examples of many possible scenarios that may be developed using various embodiments of the present invention. Based upon the disclosure provided herein, one of ordinary skill in the art will recognize a variety of other scenarios that may be detected and/or alerts that may be generated using different embodiments of the present invention.

In conclusion, the present invention provides for novel systems, devices, and methods for disrupting, predicting and/or monitoring criminal behavior. While detailed descriptions of one or more embodiments of the invention have been given above, various alternatives, modifications, and equivalents will be apparent to those skilled in the art without varying from the spirit of the invention. Therefore, the above description should not be taken as limiting the scope of the invention, which is defined by the appended claims.

What is claimed is:

1. A behavior determination system, the system comprising:
- a first monitoring device;
- a second monitoring device; and
- a monitoring system operable to:
  - receive information from the first monitoring device;
  - receive information from the second monitoring device;
  - identify at least a first zone around the first monitoring device;
  - identify at least a second zone around the second monitoring device; and
  - characterize a behavior based at least in part on an intersection of the first zone and the second zone.

2. The system of claim 1, wherein the monitoring system includes:
- a processor; and
- a computer readable medium having instructions executable by the processor to:
  - receive the information from the first monitoring device;
  - receive the information from the second monitoring device;
  - identify at least the first zone around the first monitoring device;
  - identify at least the second zone around the second monitoring device; and
  - characterize the intersection of the first zone and the second zone.

3. The system of claim 1, wherein characterizing the intersection of the first zone and the second zone includes:
- determining that a first individual associated with the first monitoring device is friendly with a second individual associated with the second monitoring device; and
- characterizing the behavior as a friendly interaction.

4. The system of claim 3, wherein the monitoring system is further operable to:
- provide an alert indicating the friendly interaction.

5. The system of claim 3, wherein the friendly interaction corresponds to a common gang affiliation of the first individual and the second individual.

6. The system of claim 3, wherein the monitoring system is further operable to:
- define a common zone around both the first monitoring device and the second monitoring device.

7. The system of claim 6, wherein the interaction is a first interaction, and wherein the monitoring system is further operable to:
- receive information from a third monitoring device;
- identify at least a third zone around the third monitoring device; and
- characterize a second interaction of the third zone and the common zone.

8. The system of claim 7, wherein the behavior is a first behavior, and wherein characterizing the second intersection includes:
- determining that a first individual associated with the first monitoring device is unfriendly with a third individual associated with the third monitoring device; and
- characterizing a second behavior based at least in part on the second interaction as an unfriendly interaction.

9. The system of claim 1, wherein characterizing the intersection of the first zone and the second zone includes:
- determining that a first individual associated with the first monitoring device is unfriendly with a second individual associated with the second monitoring device; and
- characterizing the intersection as an unfriendly interaction.

10. The system of claim 9, wherein the monitoring system is further operable to:
- providing an alert indicating the unfriendly interaction.

11. The system of claim 9, wherein the friendly interaction corresponds to an adverse gang affiliation of the first individual and the second individual.

12. The system of claim 1, wherein the behavior is attributed to an individual associated with the first monitoring device based at least in part on the intersection of the first zone and the second zone.

13. A method for behavior determination, the method comprising:

monitoring a first location of a first monitoring device;

monitoring a second location of a second monitoring device;

receiving the first location from the first monitoring device;

receiving the second location from the second monitoring device;

identifying at least a first zone around the first monitoring device;

identifying at least a second zone around the second monitoring device; and characterizing a behavior based at least in part on an intersection of the first zone and the second zone.

14. The method of claim 13, wherein characterizing the intersection of the first zone and the second zone includes:

determining that a first individual associated with the first monitoring device is friendly with a second individual associated with the second monitoring device; and characterizing the behavior as a friendly interaction.

15. The method of claim 14, wherein the method further comprises:

providing an alert indicating the friendly interaction.

16. The method of claim 14, the method further comprising:

defining a common zone around both the first monitoring device and the second monitoring device.

17. The method of claim 16, wherein the interaction is a first interaction, and wherein the method further comprises:

receiving information from a third monitoring device;

identifying at least a third zone around the third monitoring device; and characterizing a second interaction of the third zone and the common zone.

18. The method of claim 17, wherein the behavior is a first behavior, and wherein characterizing the second intersection includes:

determining that a first individual associated with the first monitoring device is unfriendly with a third individual associated with the third monitoring device; and characterizing a second behavior based at least in part on the second intersection as an unfriendly interaction.

19. The method of claim 13, wherein characterizing the intersection of the first zone and the second zone includes:

determining that a first individual associated with the first monitoring device is unfriendly with a second individual associated with the second monitoring device; and characterizing the intersection as an unfriendly interaction.

20. The method of claim 19, wherein the method further comprises:

providing an alert indicating the unfriendly interaction.

21. A computer readable medium, the computer readable medium comprising non-transitory instructions executable by a processor to:

receive information from the first monitoring device;

receive information from the second monitoring device;

identify at least a first zone around the first monitoring device;

identify at least a second zone around the second monitoring device; and characterize a behavior based at least in part on an intersection of the first zone and the second zone.

* * * * *